United States Patent [19]

Scheitza

[11] Patent Number: 4,925,078

[45] Date of Patent: May 15, 1990

[54] GRIPPER FEED DEVICE

[75] Inventor: Matthias Scheitza, Weiterstadt, Fed. Rep. of Germany

[73] Assignee: Leinhaas Industrieberatung, Gelnhausen, Fed. Rep. of Germany

[21] Appl. No.: 281,540

[22] Filed: Dec. 8, 1988

[30] Foreign Application Priority Data

Dec. 23, 1987 [EP] European Pat. Off. ..... 87119094.8

[51] Int. Cl.[5] ..... B65H 20/16

[52] U.S. Cl. ..... 226/108; 226/142

[58] Field of Search ..... 226/108, 112, 137, 139, 226/141, 142

[56] References Cited

U.S. PATENT DOCUMENTS

| | | | |
|---|---|---|---|
| 2,468,236 | 4/1949 | Rue | 226/90 |
| 3,583,268 | 6/1971 | Scribner | 226/112 |
| 4,580,710 | 4/1986 | Ledgerwood | 226/141 |
| 4,610,380 | 9/1986 | Plumb | 226/142 |

FOREIGN PATENT DOCUMENTS

| | | |
|---|---|---|
| 0033252 | 1/1981 | European Pat. Off. . |
| 0125367 | 11/1984 | European Pat. Off. . |
| 1265106 | 4/1968 | Fed. Rep. of Germany . |
| 1811302 | 10/1969 | Fed. Rep. of Germany . |

OTHER PUBLICATIONS

Brochure "Differenzdruckpresse"—Leinhaas (Differential Pressure Press-Leinhaas) 6 pages.

*Primary Examiner*—Stuart S. Levy
*Assistant Examiner*—Paul Thomas Bowen
*Attorney, Agent, or Firm*—Marmorek, Guttman & Rubenstein

[57] ABSTRACT

A gripper feed devices comprises a housing, first and second tension grippers, first and second toothed rods fixedly connected to the first and second tension grippers, and a rotatable pinion meshing with the toothed rods for converting the rotational movement of the pinion into linear, symmetrical movement of the tension grippers in opposite directions. The pinion is cyclically driven, via a main shaft and a crank disk mounted on the main shaft, by two piston/cylinder arrangements connected at different points on the crank disk. The two piston/cylinder arrangements are designed to operate alternately and in opposite directions, thus imparting a cyclical rotation to the pinion. An adjusting disk mounted on the main shaft and an adjusting sled to which the piston/cylinder arrangements are connected are also provided to vary the stroke length of the piston, and thereby the extent of linear movement of the tension grippers.

17 Claims, 2 Drawing Sheets

FIG.1
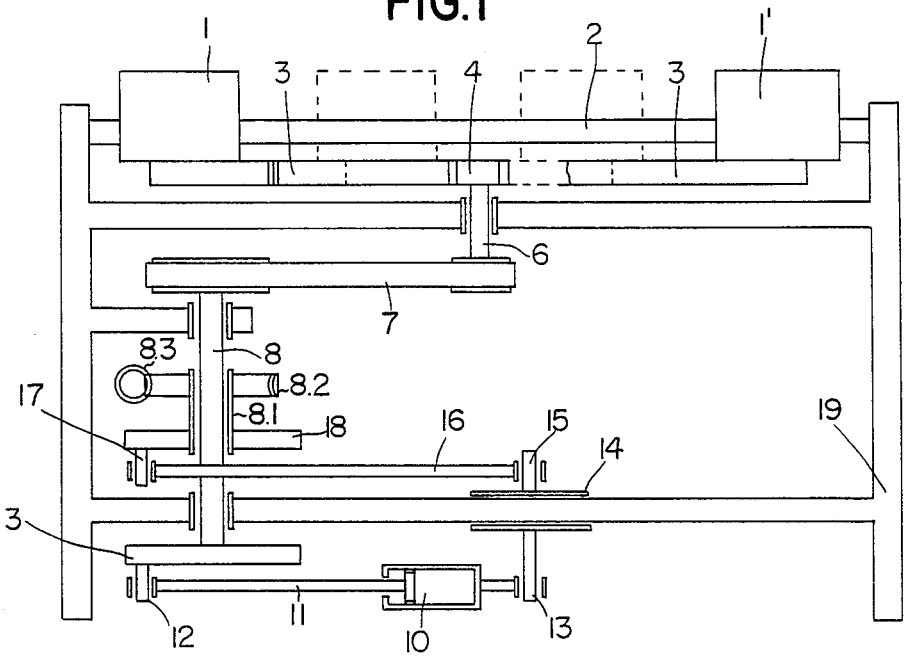
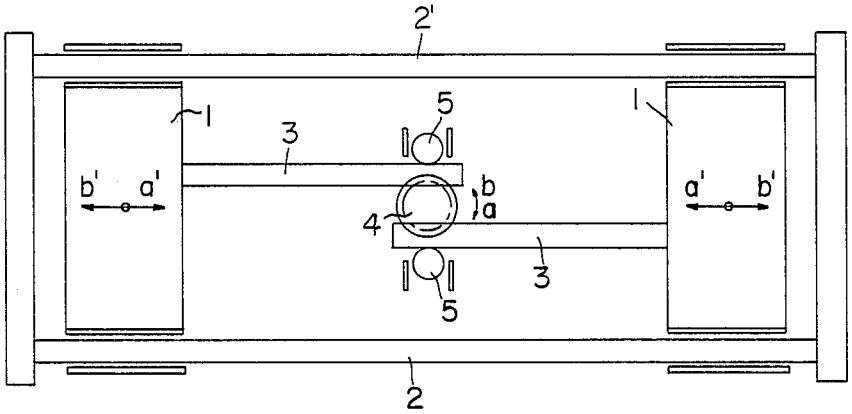
FIG.2

GRIPPER FEED DEVICE

BACKGROUND OF THE INVENTION

The instant invention relates to a gripper feed device with pneumatic or hydraulic crank drives As can be seen from studying pertinent technical literature, the trend in the fabricating industry is away from the mass product and towards greater diversification of individual product groups and simultaneous reduction of lot sizes.

It is therefore increasingly necessary to render operating and automation systems more flexible. This does not present great difficulties when the fabrication of simple parts with modest quality requirements is involved. But as quality requirements increase with respect to dimensional stability and complexity, the automation technology used becomes more comprehensive and soon reaches the limits of economic practicality. This is true above all in production fields such as chipless shaping and in particular with punching techniques which have traditionally been highly automated. Since the possibilities for automation are relatively simple for technological reasons, thorough investigations reveal again and again that the known automation techniques have not kept pace with the development of machines. Often completely new designs are needed, as constant adaptation of existing methods must finally lead to a dead end.

It is the object of the instant invention to present such a new design for a gripper feed device with pneumatic or hydraulic crank drives for automatic forward feed of band, strip or profile material in presses, punching presses or similar machines.

This development was initiated, in addition to what has been said above, through the fact that the brochure "Differential Pressure Press—Leinhaas" (published in German in December, 1987) documents such a press which can be automated with conventional, commercially obtainable automation devices only by sacrificing its considerable technological advance. It will become clear that the mentioned new designs, and here in particular the above-mentioned forward feed, is considerably better from the point of view of its technology as well as of its cost than clumsy adaptations of existing technologies.

Only five applications and patents dealing with the abovementioned objectives have been found in the German and the European Patent Office, and these only partially touch upon the problems described.

One of these U.S. Pat. No. 2,468,236 of the year 1949, relates to a double gripper feed device which is driven directly by the press in an entirely mechanical manner.

In addition, four published documents are here described and examined with respect to their relevance.

(a) DE-AS 1,265,106

This relates to a pneumatic double gripper feed device in which each of the two grippers moves forward and backward under the impulse of its own drive. The separate adjustments of the two grippers which are necessary in this case prove to be a disadvantage, as the precision of identical operation is affected thereby and because a huge consumption of air results from the utilization of two drive aggregates. It is true however that the disadvantage of separate adjustments can be turned into an advantage to some extent, as it is possible to operate with cyclically separated forward feed lengths with this system, and this is in a narrow sense equal to the cyclical program run of the complete forward feed.

(b) DE-OS 1,811,302

This application describes a forward feed in which two grippers are attached to the lines of a horizontally running roller chain, whereby said lines move in opposite directions. This chain is driven cyclically by a reversible hydraulic motor which is in turn supplied by a hydraulic pump driven by an electric motor. This system is mainly provided for forward feed lengths of over 1,000 mm where the utilization of hydraulic cylinders would be too expensive and where models with the return stroke required by this system would require excessive positioning times.

(c) European OS 0033252

This patent application describes a simple forward feed with only one movable gripper which is not driven via a cylinder, but by an electro-pneumatic oscillating module which in turn cyclically rotates an adjustable-radius oscillating crank by 180° each time in the direction of or against the direction of the forward feed. To drive the feed grippers, no sinusoidal drive is used here so that as smooth a start-up and slow down as possible may be achieved. Since the stroke adjustment in this device is effected through a preadjustment of the crank radius, subsequent or new adjustment of the stroke length is only possible when the device is stopped. A further disadvantage here is the fact that even with the shortest strokes, the driven swivelling device must go each time through a full rotation and this, as mentioned earlier, leads to wastefully high air consumption.

(d) European OS 0125367

This application, the newest in the field, describes a forward feed which extensively combines the advantages of the three applications mentioned above. This application also deals with a double gripper feed device. The gripper movement in opposite directions is produced by two eccentric disks. In this case too, particularly soft starting and braking of the grippers is to be attained with this system. The stroke length adjustment of the feed grippers is carried out here as in c), by means of common pre-adjustment of the crank radii, and is also possible only when the device is stopped. The cyclical swivelling movement of the eccentric disks by 180° is achieved in this system through use of a traction driving means which surrounds both eccentric disks, whereby one trunk of said driving means is moved as needed by a pneumatic or hydraulic cylinder by the feed cycle.

The disadvantages in this system, as has already been noted under c), is the inability of setting the stroke during operation and the fact that the driving cylinder must run its full stroke even when short gripper strokes are involved. A further disadvantage of this system is found in the characteristic that the maximum stroke length of each feed gripper is limited by the diameter of the eccentric driving disk.

A study of these documents thus shows that the requirements formulated earlier with respect to a modern feed system have not yet been met satisfactorily by any of the known designs.

A fabricating process with automatic punching of bands or strips shall be discussed and examined in further detail below.

The construction of an automatic punching device for the processing of bands and strips is almost always the same. Essentially it consists of an unwinding device for the band, a so-called hasp, a dressing machine to straighten out the band which has been bent by the winding process, and a forward feed system which has the task of inserting the band cyclically and in accordance with the cycle of the press into the machine tool.

In addition to other press characteristics it is mainly the stroke which determines the quality and possible complexity of the part to be produced. Three basic requirements must be met by the advance feed system from this point of view:

1. precise positioning of the work piece, i.e. of the band or the strip,
2. positioning speed for a cycle and
3. cycle frequency so as to be able to fully utilize the number of strokes of the press.

Additional requirements are subject to the prevailing conditions, e.g., the clamping force of the band. They concern the required acceleration and the mass or the cross-section of the band to be conveyed so as to allow for rapid forward feed or sliding of the band.

Also important here is the tensile force of the forward feed necessary to pull a band through the dressing machine, depending upon its cross-section or its curve if said dressing machine does not have its own drive. Of course the tensile force also has an influence upon the maximum acceleration that can be transferred to the band.

The right forward feed system is selected so as to meet these requirements and in accordance with the task to be accomplished by the installation.

The functionality of the forward feed system is discussed in further detail below.

Precision of positioning:

Here again, two fabrication techniques with respect to the tool must be distinguished:

a. Cyclical tools by means of which a part is fabricated directly from the band during a stroke of the press, without intermediary steps, and
b. Cyclical or sequential tools where the part to be fabricated undergoes several shaping stages and is finally ejected (e.g., in free fall) by the machine.

It is easy to see that errors in positioning cannot have a cumulative effect in single-cycle tools, since only one complete shaping process takes place per stroke of the press, and possible positioning errors can only have an effect upon the economical utilization of the band, for as long as the positioning error lies within an area dividing two work pieces within the band.

With cyclical or sequential tools, however, positioning errors in the forward feed can have serious consequences for the quality of the part. This becomes quickly apparent when one considers that a work piece is perforated, bent, notched, crimped, etc. at several stations, but in one and the same tool, and is separated from the band only at the end of the shaping process. Since the shaping processes follow each other here, they would have a strong influence upon each other and affect their quality if forward feed is not precise.

In tool technology, the path to be followed is therefore that of punching holes into the band in a first station, of notching the band at its side and of then positioning the band in the tool during the following stroke of the press, i.e., at the next shaping station by means of locating pins or other stops for the ensuing fabricating processes.

In this manner the precision of positioning is thus passed from the forward advance to the tool. However, this does not in any way permit greater positioning tolerances of the forward feed, since the searching pins or the lateral stops of the tool could easily cause burrs or dents in the band when pre-punched holes or notches are not positioned exactly, and this can lead to a production stoppage of several hours in some cases if the band can no longer move in the tool as a result.

In sequential or sequence-predicated tools it is also important that they be necessarily equipped with a control variant of the forward advance when the types of tools under discussion are used. This so-called intermediary aeration consists in laying the band open briefly and completely to allow for a positioning by the tool's dressing devices.

These positioning tolerances of the forward feeds move in a range from 2/100 to 1/10 mm, depending upon the forward feed system used.

When one considers the explained path/time characteristics of differential-path, differential-pressure or eccentric presses, and taking into account the total time required for one stroke lift, that which was discussed initially becomes clear. While a major portion of the total stroke time in an eccentric press is available for the forward advance process, these time periods shrink considerably for the desired simultaneous stroke sequence with differential-path and differential-pressure presses because of the better characteristics for shaping.

When these predetermined time periods are not respected, only limited utilization of automatic operation of a press is possible as the press must wait each time for the end of the forward feed process. In addition to an undesirable acceleration and braking process, this also leads to considerable time delays in controls, since the control processes of electric, hydraulic or mechanical control elements do not take place in infinitesimally short time periods and are generally cumulative.

It is said in that case that the press does not have a chance to run through. Concerning the forward feed, the adjusting speed can be influenced through the utilization of very fast controls, light-weight construction elements and an appropriate damping system for the cyclically moving parts of the forward feed. Since the often insufficient adjusting speed of conventional forward feeds utilized in modern press systems often reduces the theoretically possible number of cycles drastically, special attention was given to this point in developing the instant invention.

In the brochures of pertinent automation and forward feed device manufacturers, it is almost always the cyclical speed which is played up. But it is calculated only for the forward feed running by itself alone, that is to say without the press, and therefore does not take into account the shaping time of the press while the forward feed is stopped. These brochures therefore often give a wrong picture of the capacity of the forward feed device involved. However, when the necessity for a high adjusting speed of the forward feed, as described above, is taken into account, high cycle numbers of the forward feed result almost automatically, since the switching times of the forward feed control are generally not longer than the shaping times of the press.

To solve the problems described above, two types of forward feed devices have proven themselves best until now. These are on the one hand gripper feed devices in which the band is clamped by means of a movable gripper and in which said gripper is moved towards the press when used for pushing and is moved away from the press when used for pulling, and on the other hand roller feed devices in which the band is clamped between two rollers running in opposite directions and is pushed forward as a roller movement is carried out.

A further distinction can be made with regard to the drive. Here the forward feed systems with their own drives are distinguished from those with external drives originating at the press. The best results can obviously be achieved with the latter, since the forward feed necessarily follows the press characteristic directly. Its utilization is however restricted to the eccentric or the crank presses as the determination of the press characteristic through the rotating eccentric shaft is especially simple in that case. For high-speed punching with high-speed presses only gear-driven forward feed devices are used since at cyclical speeds of 1,500 strokes/minute it is no longer possible to synchronize the press cycles with the forward feed cycles through control means.

The instant invention deals with forward feed systems having their own drives. A comparison of devices under the two aspects of gripper feed devices and roller feed devices will now be discussed.

In a gripper feed device the band is conveyed, as mentioned before, through cyclical, linear movement of the forward feed gripper which clampingly holds the band. During the back-stroke of the forward feed gripper, a stationary holding gripper now takes over the fixing of the band. Gripper feed devices must therefore perform one return stroke per cycle in order to bring the forward feed gripper back into its starting position.

The forward feed gripper is driven by pneumatic or hydraulic cylinders, with the pneumatic system being used for smaller band widths, i.e., for smaller gripper sizes of approximately 250 mm and for shorter forward feed strokes of up to approximately 350 mm. When these dimensions must be exceeded, hydraulic drives are used as it is possible to transmit greater forces with these and because the pneumatic systems become uneconomical here with respect to air consumption and adjusting speed.

The clamping forces in the holding or forward feed grippers are also obtained by pneumatic or hydraulic means depending on the drive of the forward feed by means of short stroke or bellows cylinders.

The stroke/lift of the forward feed gripper is limited by means of one or two adjustable stops. Generally the adjustment is subdivided into rough and fine adjustment and in most machines is only possible when the device is stopped. Depending upon the expense of the machine, the stroke is determined either by simply measuring the stop position by means of sliding calipers, by means of mounted scales with a vernier and, in very expensive machines, by means of mechanical or electronic measuring devices.

The greatest technical problem with gripper feed devices is the braking of the grippers in their end positions. Here, pneumatic or hydraulic/pneumatic damping systems with adjustable damping are used, but their effective braking path is always constant with respect to the stroke executed by the forward feed gripper. Depending upon the stroke length, the plate crosssection and the set stroke speed, it is necessary to adjust damping to the new parameters each time this damping system is used. The wastefulness of such "energy eating devices" becomes especially apparent when one considers that the damping unit must not only brake the mass of the accelerated gripper alongside the damping path, but must also absorb the energy of the drive in full operation during the entire damping period. This is intrinsically unavoidable with the conventional gripper feed devices because there is no assurance that the gripper will go precisely into its end position when the drive is stopped prematurely.

For the above-described reasons, and due to the fact that the setting of the forward feed parameters can be automated only at a certain cost, the roller forward advance has often been given preference during the last few years.

The system of the roller forward advance shall now be described.

As mentioned earlier, in roller feed devices the band to be advanced is clampingly held between two rollers of which either one or both are driven and is pushed forward by the opposing movements of the rollers. The driving force, especially with very large roller feed devices, is mainly obtained through hydraulic motors, and with smaller ones by using stepping motors the rotation of which is generally transmitted to the rollers by light-weight toothed belt drives.

The construction is also much simpler in this form than is the case with gripper feed devices. Due to the principle of rollers running in opposite directions, this forward feed device remains continuously in starting position, i.e., no back-stroke is necessary. Furthermore, it is therefore possible to run programs, e.g., forward feed of 10 mm, forward feed of 20 mm and then again forward feed of 10 mm, each during one stroke of the press.

The clamped position between the rollers, which theoretically follows a line, often presents a problem. For this reason the band may slide through at high rotational accelerations of the rollers and may be crushed or indentations may be produced on the band when soft work materials are conveyed, such as for example aluminum. The required intermediary aeration mentioned initially, i.e., the laying open of the band for brief periods between two forward feed movements often present technical difficulties when sequential tolls are used. Here mechanical devices such as adjusting cams or pneumatic systems are used in order to briefly lift up one of the rolls.

The above-described effect of dents being made on the band is of course further reinforced by the re-application of the roller.

Due to the fact that here the movement does not occur between two stops but that the rollers are started and stopped freely, the adjustment with roller feed devices is considerably less precise than with gripper feed devices. If the band slides through, this problem is of course aggravated even further.

Despite these disadvantages the roller feed device has found a wider use during the last few years than the gripper feed device because of the ease with which it can be automated (no additional measuring or adjusting link is required). Above all, a new design should now strive to combine the advantages of both forward feed device types from the point of view of flexibility as mentioned initially, and to avoid their disadvantages as much as possible.

It is apparent from these explanations that the roller feed device, considered purely from a quantitative point of view, and speaking only of technical advantages, is superior to the gripper feed device. However, it has much greater requirements as to controls, and this again is often a disadvantage when considered in the light of economy.

If the advantages and disadvantages of the described feed devices are considered from a qualitative point of view, the disadvantages of the roller feed device with respect to precision and band clamping prove to be intrinsic to the system, and therefore unavoidable. However precision is the most decisive factor in determining the suitability of machines, devices and tools used in shaping processes. This defect is especially serious when the forward feed is used with machines of the newest design, such as for example presses operating on the differential pressure principle. Since these machines are above all used for the fabrication of especially complex and high-quality parts, as a matter of practically, only gripper feed devices can be used here, with the disadvantages which are proper to these devices.

In order to solve the existing problems, it would be ideal to combine roller and gripper feed device, as the disadvantages of one system could be compensated here by the advantages of the other. The solution of this problem, i.e., the combination of the advantages of roller and gripper feed devices is the actual goal of the instant invention, whereby the following requirements are sought to be achieved:

1. Band clamping over the greatest possible surface so as to make it possible for a band to be conveyed safely and with care, even with high clamping forces but low pressures being applied;
2. Forward feed movement without the occurrence of return strokes, i.e., the forward feed system must again be in starting position after execution of the positioning movement;
3. Decrease of the required braking force;
4. Soft, if possible jolt-free, starting of the forward feed movement;
5. Avoidance of clearance volumes as a result of the adjustment of the forward feed length when pneumatic drives are used;
6. Possibility of adjusting or readjusting forward feed lengths during operation;
7. Compact construction with a minimum of projecting parts;
8. Delimitation of forward feed by pre-adjustable stops so as to ensure a maximum of precision of the forward feed action.

First of all, solutions must be found based purely on qualitative considerations in order to meet these requirements.

A first design selection can already be made on basis of the above-mentioned criteria. The requirement for the widest possible clamping surfaces precludes from the very start the utilization of rollers running in opposite directions. Furthermore, the requirement that adjusting times should be brief, i.e. that high accelerations are needed which can only be obtained with extremely light-weight drives, leads to the utilization of pneumatic or hydraulic aggregates.

The two resulting requirements, considered alone, fit exactly into the schematic of the earlier-described gripper feed device. All other considerations must therefore be made in that direction.

Under this point of view, the requirement for the absence of any back-stroke leads to the surprising solution of providing two clamping grippers in a row, also in the direction of forward feed, and to move not only one, but both grippers in opposite direction according to the forward feed cycle. When the machine is stopped and the tool is closed, the gripper which is then in starting position assumes the task of the previously fixed holding gripper. Following a forward feed signal, the closed gripper advances and thereby forward-feeds, while the second, open gripper runs back and is again in starting position after completion of the cycle.

Because of the requirement for a minimum of air consumption and simple adjustment which is also possible in operation, a solution consisting in providing each of the two grippers with its own drive aggregate must also be eliminated, since each drive would again have to carry out a return stroke and this would increase the cost of air consumption and would require that each drive be equipped with its own stroke adjustment, going counter to the requirement of simplicity and ease of operation. Furthermore, if two adjusting devices were to be used, this would not ensure that both grippers would execute the same stroke length as is indispensible for the functioning of a system with two movable grippers The grippers are therefore connected to each other via a mechanical system and are set in motion by a central drive. To meet the requirement of jolt-free acceleration and deceleration of the driving force within the range of the set end position of the forward feed gripper, a link drive of any design can be used in the drive system of the forward feed device The search for control technology solutions is here abandoned from the start, as these would probably not have a sufficiently rapid reaction time and would furthermore be too costly with a hydraulic drive, and even impossible to use with a pneumatic drive because of the compressibility of air.

Following these considerations, a picture of the equipment to be provided emerges:

1. Two forward feed grippers running in opposite directions and arranged in a row, in the direction of forward feed;
2. Mechanical, geared, if possible positive coupling between the two grippers;
3. Central pneumatic drive (a pneumatic system is preferred here over a hydraulic system because a prototype that may be built should at first be of small dimensions as this is fully sufficient to test the system);
4. Acceleration characteristic through utilization of a link drive which operates according to a trigonometric function.

SUMMARY OF THE INVENTION

The overall object of the invention is achieved in a gripping feed device having two stretching grippers guided in guides provided on both sides of the device, and for the two grippers to be interlockingly and movably connected near the drive via toothed rods which are fixedly mounted to them and to a rotatably mounted pinion meshing with the toothed rods. The two grippers move towards each other when the pinion rotates in the direction a, and the grippers move away from each other when the pinion rotates in opposite direction b, whereby the cyclical swivelling motion of the pinion is transformed by the facing toothed rods into a cyclical back and forth movement of the grippers in opposite directions. The device further includes pressure rollers which are adjustably mounted to press the toothed rods against the pinion. The pinion is driven by a crank disk via a main shaft by the cyclical rotational motion of a crank disk. The cyclic rotation of the crank disk follows a sinusoidal function which is achieved by connecting the piston rods of two separately operable pressure cylinders to two different points on the crank disk. The pressure cylinders are mounted for swivelling motion around a bearing pin which is mounted in an adjusting sled, the swivelling motion being independent of the functioning of the system. Another bearing pin is provided on an opposite side of the adjusting sled and is connected via a connecting rod to an adjusting disk. The adjusting disk is mounted for independent rotational movement on the main shaft on which the crank disk is also mounted. The crank disk is further provided on its periphery with a cam which activates an independently installed switch to activate each of the two cylinders in turn.

A reducing gear step, e.g., a chain or belt drive can be interposed between the main shaft and the shaft on which the pinion is mounted.

The stroke length of the grippers is determined through the adjustment of the position of the bearing pin of the adjusting sled relative to the position of the crank pin or the crank disk projecting in the same plane via the pressure cylinder and its piston, whereby the range of adjustment is limited by the useful stroke of the piston rod in the pressure cylinder. As to the question how the adjustment, or by what means said adjustment is made, this will be discussed later in the course of the description.

It should be noted with respect to the arrangement of the two cylinders that these are installed on the crank disk and on a tension gripper in such manner that when the piston rod goes back in direction of the tension gripper, the torque to the axis of the cam plate is strongly decreased towards the end position and that the retracting cylinder plays the role of a damping cylinder.

It is proposed that in order to adjust the stroke length, a second disk be assigned to the adjusting disk which is mounted rotatably on the shaft on a bushing, the periphery of said second disk being provided with worm gearing, engaged by an endless screw and that the bearing pin located on the periphery of the adjusting disk alter its position when the endless screw rotates, whereby the distance between the main shaft and the tension gripper is adjustable via the connecting rod and that this adjustment results also in a corresponding adjustment of the distance between the crank pin and the pin via the piston rod and the cylinder.

Through these additional or completing measures, the invention is disclosed in whole.

For the sake of clarity and to allow for comparisons with conventional roller or gripper feed devices, the advantages of the system according to the invention are discussed here once more.

Wide-surface clamping by means of a tension gripper make it possible to transmit higher tension forces at lower pressure. Thereby, secure clamping of the band is ensured, while the band is handled with a maximum of care.

Cyclical gripper movement occurs in opposite directions, whereby one of the grippers is in starting position. Back strokes are not necessary.

Both grippers are moved by one drive, and this always ensures synchronized gripper movement while the length of the overall system is short. Optimal precision of positioning is achieved thanks to the process between two stops.

Forward feed or resetting is made possible by changing the gearing distance between pinion and toothed gear.

Also in embodiments with long strokes, only small oscillating disks, i.e. low torque is required, since only the reduction of the transmission link which follows the drive aggregate must be changed here. To obtain equal forward feed forces, it would suffice to build in a drive cylinder with a greater surface of the piston cross-section but with identical stroke length.

Minimal air consumption occurs, because the drive cylinders start from their end positions, independently of the setting of the forward feed length.

Greatly reduced braking force is required because the accelerating forces or the torques decrease continuously towards the end of the stroke.

Modification of the braking path is achieved by means of positive-driven cams, automatically synchronized with the adjustment of the stroke length. Because of this, no or only little regulating of the damping force to adapt to the new stroke conditions is necessary.

Under extreme conditions it is possible to increase the forward feed force considerably by means of pressure in the pressure chamber of the cylinder on the side of the piston rod. Stroke adjustment or readjustment is possible during operation and presents no problems. This greatly facilitates the setting and the supervision of the machine. All parts of the machine are easily accessible for assembly and maintenance tasks thanks to the frame which is open on both sides.

BRIEF DESCRIPTION OF THE DRAWINGS

The gripper feed device according to the instant invention is explained in greater detail through the drawings of an embodiment of the invention in which, FIG. 1 shows the device in a side view;

FIG. 2 shows a top view with the two tension grippers which can be displaced in the guides on both sides;

DETAILED DESCRIPTION OF PREFERRED EMBODIMENTS

Figure 3:
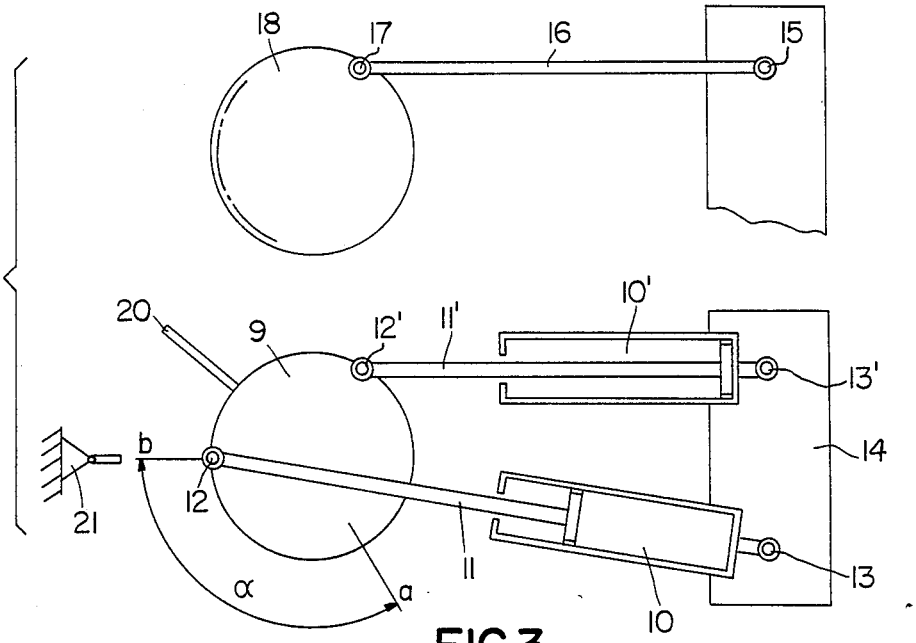
FIG. 3 shows the operating principle of the drive and of the adjusting device separately.

Referring to FIG. 1, tension grippers 1,11 are shown in their outermost end positions by continuous lines and in their innermost end positions by broken lines. As best seen in FIG. 2, the tension grippers 1,11 are guided in the guides, 2 on either side of the devices. Both tension grippers 1,11 are here connected to each other on the drive side by the two toothed rods 3 which are fixedly mounted on them and by the rotatably mounted pinion 4 in a positive locking, movable manner. When the pinion 4 rotates in direction a, the two grippers execute a motion a towards each other. When the pinion 4 rotates in direction b, the tension grippers 1,11 move away from each other in direction b'. The cyclical swivelling motion of the pinion 4 is therefore transformed into a cyclical gripper movement in opposite directions by the facing toothed rods 3. In order to be able to adjust this drive arrangement without clearance in accordance with the required forward feed tolerance, adjustable pressure rollers 5 are installed flush with the pinion 4 on the toothed rod 3 on the side away from the teeth.

The earlier-described pinion 4 is now driven by the main shaft 8 via shaft 6 and the reducing gear step 7 (shown here in the form of a belt drive). The cyclical rotation (corresponding to a sinusoidal function) of shaft 8 is produced here by the crank disk 9 which is firmly connected to shaft 8. Reference numeral 10 indicates one of the driving pneumatic or hydraulic cylinders which has a piston rod 11 that is connected pivotably to the crank pin 12, also mounted on the crank disk 9, and whose cylinder pipe is also able to swivel around the bearing pin 13.

Referring now to FIG. 3, if the cylinder 10[1] on the piston rod 11[1], on the side away from the piston, is put under pressure, the crank disk 9, driven by the piston rod 11[1] and by the bearing pin 12[1], rotates in direction a. The cylinder 10 is thereby brought back into its starting position by its piston rod 11 and the crank pin 12 until the piston again makes contact with the back wall of the cylinder. During the following cycle the cylinder 10 is again put under pressure and the previously extended cylinder 10[1] is brought back into its starting position, whereby the crank disk 9 now rotates in the direction b. It clearly appears from the drawing of the end position of the drive unit that the torque produced by the cylinder or the axis of the cam plate continuously decreases towards the end position. This in turn decreases the braking force to be produced by the retracting cylinder which plays the role of a damping cylinder. The throttling function of the retracting cylinder is to be switched on in this system via a cam 20 centrally located between the bearing pins 12 and 12[1] which triggers a switch 21 during each passage through the center line of the crank disk 9, shown here in horizontal position. Since each cylinder movement is alternately symmetric, the cam 20 always runs past switch 21, whatever the adjustment of the half-turn of the crank disk 18 at the time. The length of the braking path is therefore not always constant, as in the conventional forward feed devices, but is always equal to one half the forward feed length.

The adjustment of the forward feed length of the tension grippers is achieved by the adjustment of the swivelling angle of the adjustment disk 18 in that the tension gripper 1, on which the two cylinders 10 and 10[1] are attached articulately by means of the bearing pins 13 and 13[1], is shifted in the direction of the adjusting disk 18 when the length of forward feed is reduced and is moved away from it when the length of forward feed is increased. Since a movement of the adjusting sled 14 is not required for the operation of the system, an adjustment of the stroke lengths during operation is possible without any problems.

Figure 4:
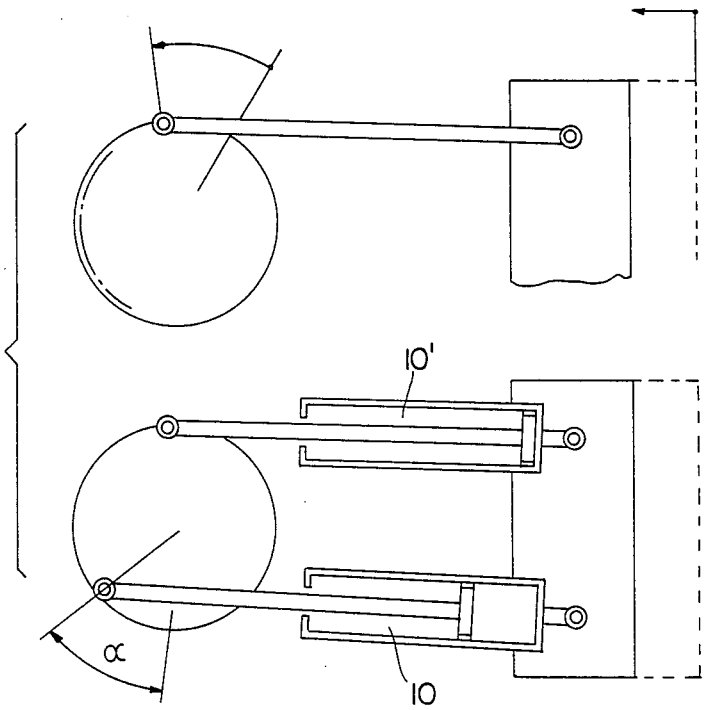
FIG. 4 shows the drive unit with stroke lengths that are shorter than in FIG. 3.

It can be seen from FIG. 4 that the piston of the cylinder 10[1] reaches its end position after a considerably shorter stroke of cylinder 10.

Since the piston of the drive cylinders always start from their end positions, whatever the set stroke length of the tension grippers 1,11 an adjustment of the forward feed length does not produce a clearance volume which would have to be put under pressure each time when pneumatic cylinders are used, thus increasing air consumption in a costly manner. By using two independent pressure cylinders operating in opposite directions, yet another advantage of this drive system is achieved. This is due to the fact that the cylinders can also be put under pressure by using pressure means on the piston side closest to the piston when especially great forward feed forces are desired. When hydraulic cylinders are used, this characteristic makes it possible to use a particularly small and compact drive system with great forward feed forces.

The kinematic motion equation of the drive system can be derived from the equation of the offset crank drive which is known in mechanical technology.

The adjusting disk 18 is connected to the adjusting sled 14 via the bearing pins 15 and 17 and via the connecting rod 16 interconnecting them. When the adjustment disk 18 rotates, the adjusting sled 14 therefore moves towards the crank disk or away from it, depending on the direction of rotation. If the connecting rod 16 is parallel to one of the driving cylinders in any plane, rotation by a few degrees of the adjusting disk 18 moves adjusting sled 14 and results in a change of the swivelling angle of the crank disk 9 as illustrated in FIG. 4.

Considering that the maximum swivelling angle of the crank disk 9 is determined by the position of the bearing pins 12 or 12[1] in their end or starting positions, and that the bearing pin 17 aligns precisely with that position, although at a parallel offset, the linear interdependency of the set angle of the adjusting disk 18 and of the set swivelling angle of the crank disk 9 becomes apparent.

The angle of adjusting disk 18 is set by means of gear 8.2 which is connected to disk 18 by the common hollow shaft 8.1 The gear 8.2 meshes with, and is driven by, worm gear 8.3.

From a mathematical point of view, the movement function imposed by the adjusting disk 18 and by the adjusting sled 14 represents precisely the movement characteristic according to which the distance must be changed in order to obtain linear adjustment. At the same time the distance between the main shaft 8 and the pins 13 and 15 of the adjusting sled 14 which are installed parallel to it on an axis is defined.

In conclusion, the following should be noted:

FIG. 1 shows an embodiment wherein the adjusting disk 18 is not mounted next to the crank disk 9, as shown in FIGS. 3 and 4, but over it. This makes for compact construction FIG. 1 also clarifies the compact construction of this principle. The construction length is determined here only by the stroke of the gripper and is not greater than with conventional gripper feed devices where the space for the second tension gripper shown here would be needed for the driving cylinder. Furthermore it is possible to keep the frame 19 open on both sides for better access for assembly and maintenance tasks.

While the invention has been described by reference to specific embodiments this was for purposes of illustration only and should not be construed to limit the spirit or the scope of the invention.

I claim:

1. Gripper feed device, comprising a housing, first and second tension grippers symmetrically disposed for movement along first and second linear axes respectively, rotatable drive means interconnecting said first and second tension grippers, said rotatable drive means symmetrically driving said first and second tension grippers towards each other when said rotatable drive means rotates in one direction and away from each other when said rotatable drive means rotates in a counterdirection, cyclical rotational movement of said rotatable drive means being converted into cyclical linear movement of said tension grippers in opposite directions, a main shaft connected to said rotational drive means and cyclically driving said rotational drive means, a crank disk connected to and driving said main shaft, a first piston/cylinder arrangement including a first pressure cylinder and a first piston having a first piston rod pivotably connected at a first point to said crank disk for rotationally driving said crank disk and thereby said main shaft, a second piston/cylinder arrangement including a second pressure cylinder and a second piston having a second piston rod pivotably connected at a second point to said crank disk for rotationally driving said crank disk and thereby said main shaft in a direction opposite to said first piston/cylinder arrangement, and camming means associated with said crank disk for alternately actuating said first and second piston/-cylinder arrangements.

2. The gripper feed device of claim 1 further comprising an adjusting sled spaced at a variable distance from said crank disk, said first and second cylinders being connected to said adjusting sled, and an adjusting disk, coaxial with said crank disk, mounted for independent slidable rotational movement about said main shaft unaffected by the rotational movement of said main shaft, said adjusting disk being connected to said adjusting sled and controlling said variable distance from said adjusting sled to said crank disk, thereby controlling the extent of rotational movement of said main shaft and the extent of linear movement of said first and second tension grippers.

3. The gripper feed device of claim 2 wherein said first and second cylinders are connected for limited swivelling motion to said adjusting sled.

4. The gripper feed device of claim 2 wherein said first and second points are located at equal radial distances from the central axis of said main shaft.

5. The gripper feed device of claim 2 further comprising guide means located on opposite sides of said housing for guiding said first and second tension grippers.

6. The gripper feed device of claim 2 wherein said rotational drive means comprises first and second toothed rods fixedly connected to said first and second tension grippers respectively, and a pinion in meshing engagement with said first and second toothed rods

7. The device of claim 6 further comprising first and second pressure roller means adjustably pressing said first and second toothed rods into meshing engagement with said pinion.

8. The gripper feed device of claim 2 wherein said first and second cylinders are connected to said adjusting sled by first and second bearing pins, respectively, and said adjusting disk is connected to said adjusting sled via a connecting rod and a third bearing pin.

9. The gripper feed device of claim 2 further comprising a switch associated with said camming means for controlling the alternate actuation of said first and second piston/cylinder arrangements.

10. The gripper feed device of claim 2 further comprising a second shaft on which said rotational drive means is mounted.

11. The gripper feed device of claim 10 further comprising a gear step drivingly interconnecting said main shaft and said second shaft.

12. The gripper feed device of claim 11 wherein said gear step comprises a gear reducing step.

13. The gripper feed device of claim 12 wherein said gear reducing step includes a chain drive.

14. The gripper feed device of claim 13 wherein said gear reducing step includes a belt drive.

15. The gripper feed device of claim 2 wherein the stroke length of said first and second tension grippers is determined by adjusting the position of said adjusting sled relative to said crank disk.

16. The gripper feed device of claim 2 wherein said first and second cylinders are connected to said crank disk and to said adjusting sled in such manner that the torque applied to said crank disk decreases as either one of said first and second pistons is actuated, said cylinder which is not being actuated acting as a damping cylinder.

17. The gripper feed device of claim 2 further comprising a third disk mounted for slidable rotational movement about said main shaft, said third disk being associated with and rotating with said adjusting disk, and endless screw adjustment means located on the periphery of said third disk for varying the rotational orientation of said third and adjusting disks relative to said main shaft and thereby the distance between said adjusting sled and said crank disk, the travel distances of said first and second pistons, and the extent of linear movement of said first and second tension grippers.

* * * * *